US006230627B1

(12) United States Patent
Poe

(10) Patent No.: US 6,230,627 B1
(45) **Date of Patent: *May 15, 2001**

(54) METHOD AND APPARATUS FOR REMOVING ABANDONED OFFSHORE FIXED PLATFORM

(76) Inventor: William T. Poe, P.O. Box 45742, Baton Rouge, LA (US) 70895

( * ) Notice: Subject to any disclaimer, the term of this patent is extended or adjusted under 35 U.S.C. 154(b) by 0 days.

This patent is subject to a terminal disclaimer.

(21) Appl. No.: 09/352,604

(22) Filed: Jul. 13, 1999

Related U.S. Application Data

(63) Continuation-in-part of application No. 09/177,257, filed on Oct. 22, 1998, now Pat. No. 6,131,517.

(51) Int. Cl.[7] ..... F42B 1/02; F42B 3/00; F42B 4/06; E21B 17/01

(52) U.S. Cl. ..... 102/307; 102/312; 102/341; 102/349; 166/367

(58) Field of Search ..... 102/307, 341, 102/312, 349; 166/365, 367

(56) References Cited

U.S. PATENT DOCUMENTS

| | | | | |
|---|---|---|---|---|
| 4,787,315 | | 11/1988 | Kenny | 102/313 |
| 4,799,829 | | 1/1989 | Kenny | 405/195 |
| 5,031,540 | | 7/1991 | Kenny | 102/302 |
| 5,177,321 | | 1/1993 | Kenny | 102/312 |
| 5,467,824 | | 11/1995 | Demarsh et al. | 166/297 |
| 5,525,010 | | 6/1996 | Kenny et al. | 405/195.1 |
| 5,777,257 | | 7/1998 | Kenny | 102/312 |
| 5,791,821 | | 8/1998 | Keisler | 405/232 |
| 6,009,811 | * | 1/2000 | Newman et al. | 102/312 |
| 6,131,517 | * | 10/2000 | Poe | 102/312 X |

* cited by examiner

*Primary Examiner*—Peter A. Nelson
(74) *Attorney, Agent, or Firm*—Garvey, Smith, Nehrbas & Doody, LLC

(57) ABSTRACT

A method and apparatus for removing abandoned or obsolete fixed platforms in a marine environment is provided. The apparatus includes a delivery system having an expandable frame carrying explosive charges. The frame includes curved sections which are adjustably moved relative to one another for fitting the explosive charge members to the inside bore of a vertical leg section of the rig. A shaped charge arrangement focuses the explosive charges at a desired location on the rig leg so that when the explosive charge detonates, the rig is cut with minimal invasion of the surrounding environment.

24 Claims, 18 Drawing Sheets

METHOD AND APPARATUS FOR REMOVING ABANDONED OFFSHORE FIXED PLATFORM

CROSS-REFERENCE TO RELATED APPLICATIONS

This is a continuation-in-part of U.S. patent application Ser. No. 09/177,257, filed Oct. 22, 1998 and now U.S. Pat. No. 6,131,517, which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to improved method and apparatus for removing abandoned marine platform jackets and like fixed platforms from the seabed and for the remote placement of explosive charges using an improved delivery system. Even more particularly, the present invention relates to improved method and apparatus for removing jackets and like fixed platforms from the seabed by employing a specially configured delivery system that carries explosive charges that are to be placed inside of the hollow legs (or like tubular member) of an abandoned jacket or fixed platform, (e.g. oil well, oil production platform or the like).

2. General Background of the Invention

In the offshore oil and gas well drilling industry, there are a large number of fixed platforms that have been installed over the years in the fragile marine environment. These platforms typically involve the use of a structural steel frame or "jacket" that is comprised of a plurality of hollow tubular members, many of which are vertically oriented. In order to anchor the jacket to the seabed during installation, elongated hollow piling members are place through the vertical leg portions of the jacket and thrust downwardly into the seabed.

After a number of years of use, these offshore oil and gas well drilling platforms and production platforms can become obsolete. Under relevant laws, they are necessarily removed since they are a hazard to navigation. One of the methods of removing offshore oil and gas well drilling platforms and production platforms requires that the legs of the jacket or platform be severed below (e.g. 15 feet) the mud line. The remaining portion above the cut can be lifted from the seabed using a crane. The jacket or platform can be placed on a barge for later disposal at a suitable scrap yard or like site.

One of the problems that has faced the offshore oil and gas well drilling industry is the removal of obsolete or abandoned platforms without adversely effecting the surrounding marine environment. Typically, offshore marine environments are very delicate and should necessarily be minimally impacted by a method that is used to remove a fixed platform or production platform.

Another problem that faces a salvage company is excess expense and danger if a diver must cut the legs one at a time with an underwater cutting torch.

BRIEF SUMMARY OF THE INVENTION

The present invention provides an improved delivery system for placing explosives that enable removal of an offshore fixed platform from the marine environment. In such a situation, the platform typically has a plurality of legs that extend below the seabed, each leg or like tubular member being hollow and having a leg wall with an inside surface.

The method of the present invention first places a delivery apparatus within a leg at a selected locale, eg. the seabed area. The frame includes curved portions that tracks the curvature of the platform leg at an area to be severed.

Explosive charges are carried by the frame and positioned against the inside wall surface of the leg at a desired location.

The wall of the leg is then severed by detonating the explosive charge that has been supported with the frame.

These steps are repeated until all of the legs have been severed. The platform is then lifted from the seabed so that it can be placed on a transport barge for disposal at a fabrication yard, salvage yard, or scrap yard.

The present invention provides an improved delivery system for placing explosive charges in a pipe to be severed. The delivery system thus provides a method of placing an adjustable frame within the leg or pipe to be salvaged at the seabed area, the frame having multiple, curved charge carriers and being movable between retracted and expanded positions.

As part of the method, the frame and its explosive charges are positioned next to the inside wall surface of the leg. The frame is expanded to the expanded position so that the frame engages the leg before a detonating of the charge.

The expandable frame enables the frame to be lowered or otherwise remotely delivered to a site that would ordinarily be inaccessible.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
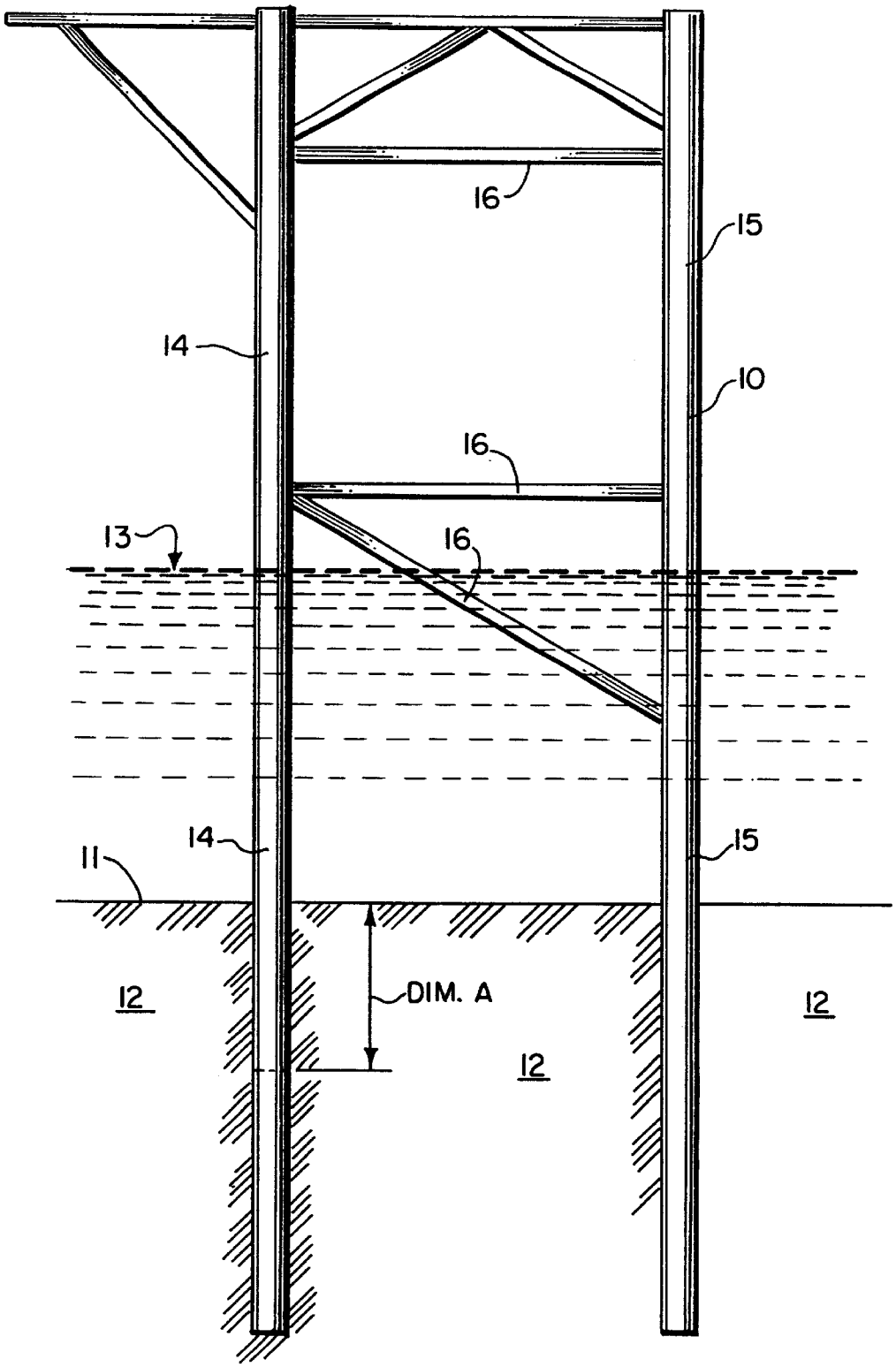
FIG. 1 is an elevational view of a typical offshore oil and gas well drilling platform prior to removal.

In FIG. 1, there can be seen a typical fixed platform 10 anchored to the seabed 12 in an offshore marine environment. The fixed platform 10 typically includes a plurality of vertical leg members 14, 15 and a number of transversely extending structural members 16. In keeping with good engineering practice, the vertical members 14, 15 are extended well into the seabed 12 a minimum dimension "A" as shown in FIG. 1, typically at least 16 or more feet.

The present invention provides a method and apparatus for removing abandoned platforms 10 that are no longer used in oil or gas well drilling or production or other related use. This is accomplished by providing an explosive apparatus 20 that is placed within the interior 17 of a selected vertical leg member 14, 15 with the help of a diver 18 that is supported by a plurality of life support cables 19 tethered from a tending vessel floating above.

Figure 2:
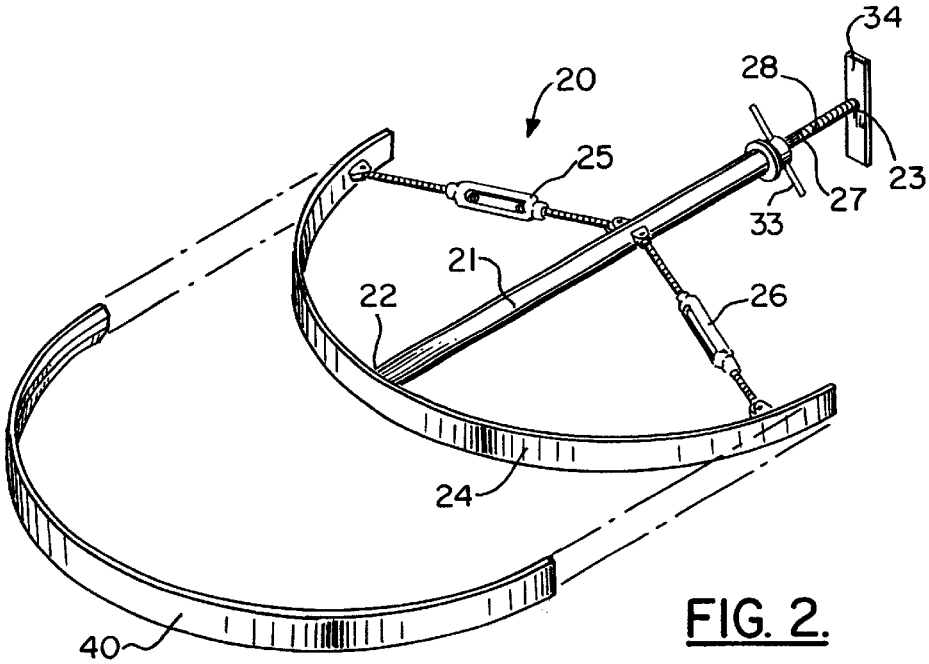
FIG. 2 is an exploded perspective view of the preferred embodiment of the apparatus of the present invention.
Figure 3:
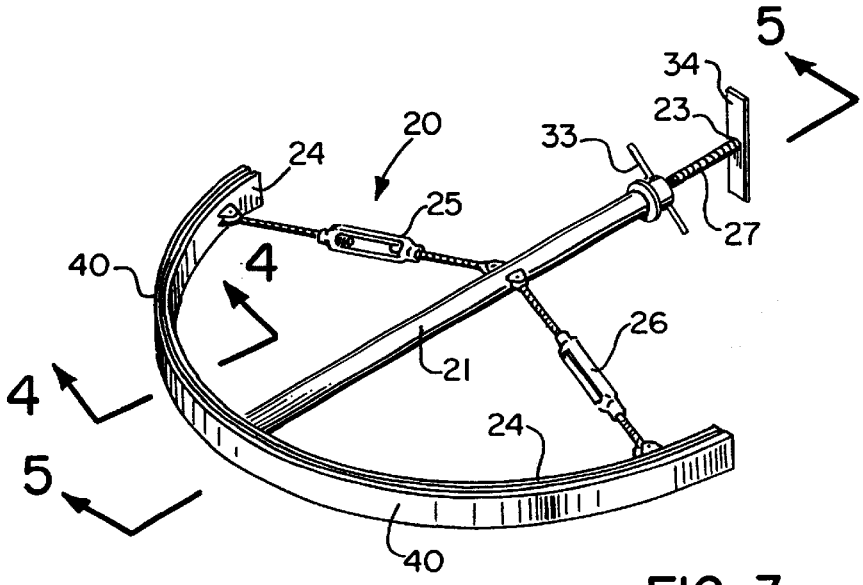
FIG. 3 is a perspective view of the preferred embodiment of the apparatus of the present invention.
Figure 4:
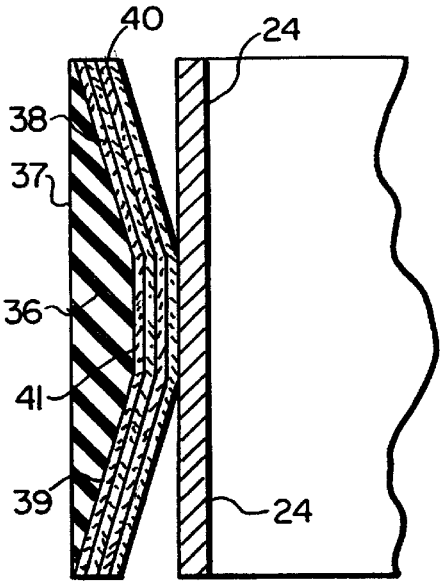
FIG. 4 is a sectional view taken along lines 4—4 of FIG. 3.

In FIGS. 3 and 4, explosive apparatus 10 includes a telescoping strut member 21 that has end portions 22, 23. The telescoping strut member 21 forms a connection at end portion 22 with curved member 24. A pair of turnbuckles 25, 26 extend between telescoping member 21 and curved member 24 as shown in FIGS. 2 and 3.

Extension and retraction of turnbuckles 25, 26 enables the user to change the curvature of the curved member 24.

Figure 5:
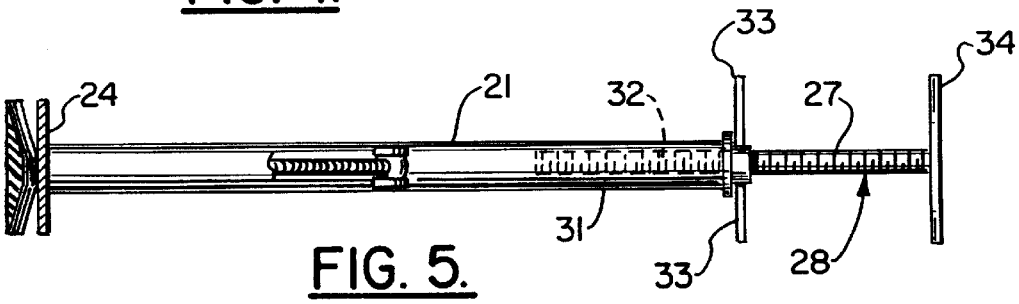
FIG. 5 is an elevational view of the preferred embodiment of the apparatus of the present invention taken along line 5—5 of FIG. 3.

The telescoping member 21 includes a telescoping threaded shaft portion 27 having external threads 28 thereon (see FIG. 5). The threads 28 engage and move with respect to correspondingly shaped internally threaded barrel 31 of strut member 21. A transverse bar 34 is affixed to threaded shaft portion 27. Handles 33 can be rotated by a user in order to extend or retract the shaft 27 relative to barrel 31.

Figure 6:
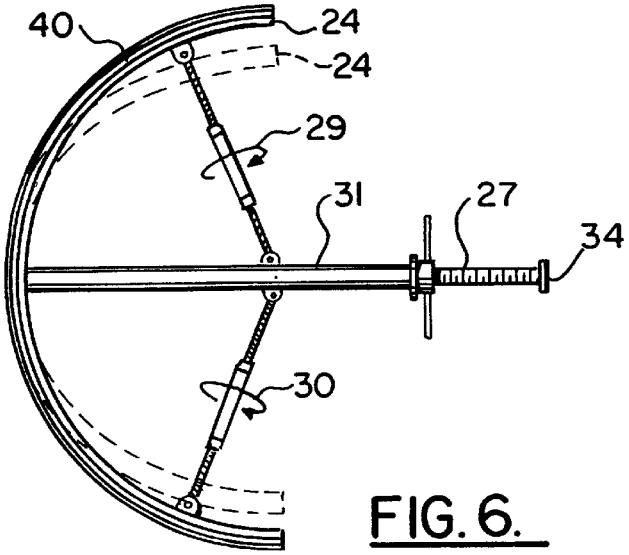
FIG. 6 is a top view of the preferred embodiment of the apparatus of the invention.
Figure 7:
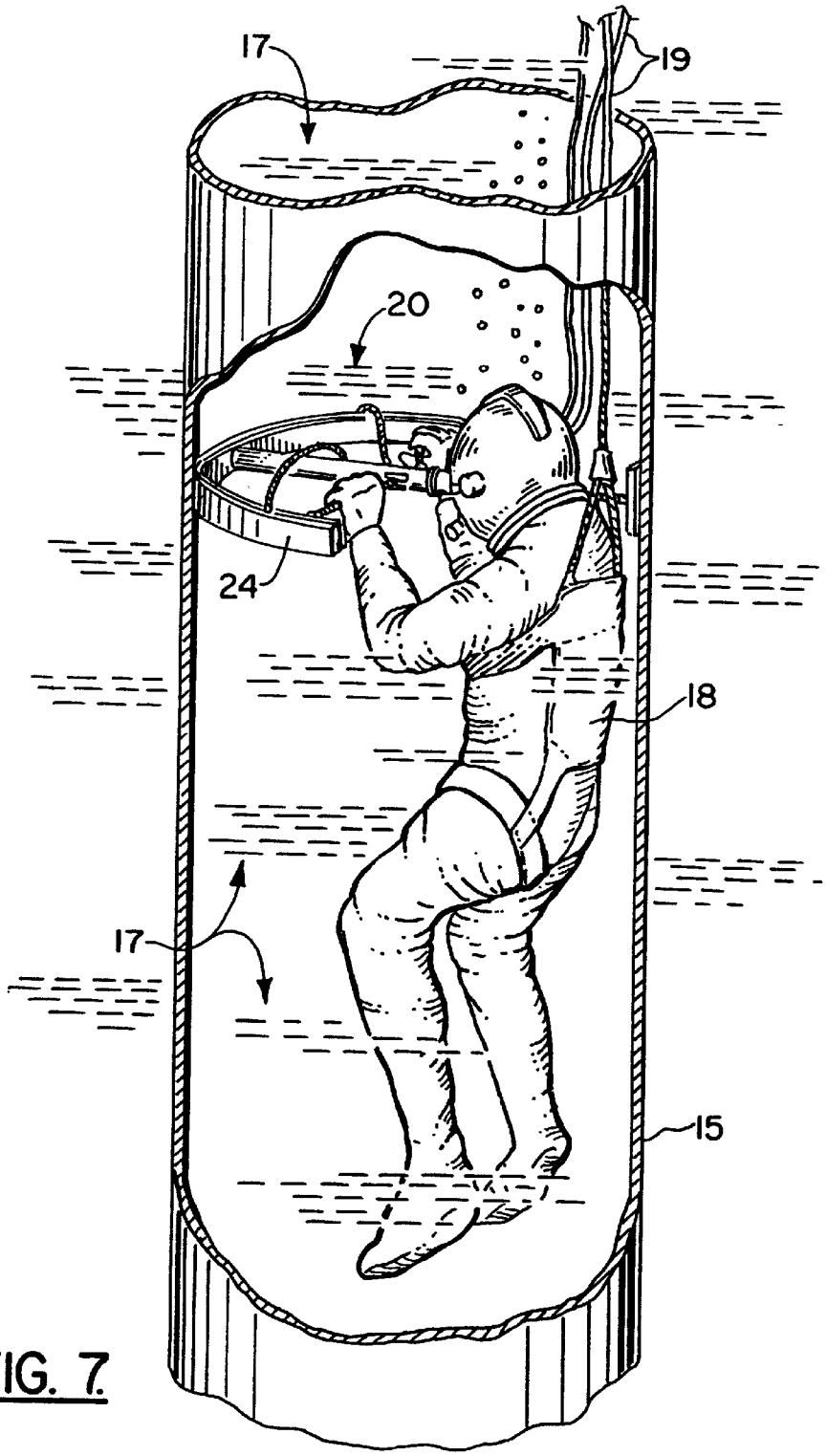
FIG. 7 is perspective cutaway view illustrating the method the present invention and showing the apparatus of the present invention during installation.

During use, a user rotates the handles 33 until the threaded shaft 27 has extended fully, wherein the bar 34 engages the inside wall surface 35 of a vertical leg member 14, 15. During use, a user also moves the turnbuckles 25, 26 in or out as shown by the curved arrows 29, 30 in FIG. 6 in order to change the curvature of curved member 24. In FIG. 6, the phantom lines show a smaller curvature for the curved member 24 and the hard lines show a larger curvature thereof.

Figure 8:
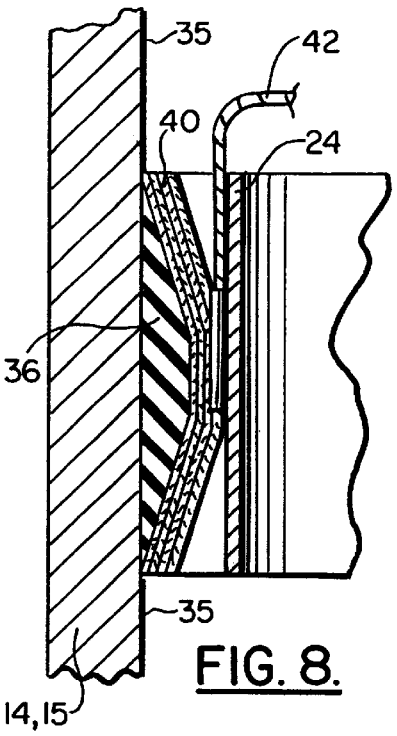
FIG. 8 is a fragmentary sectional elevational view of the preferred embodiment of the apparatus of the present invention.
Figure 11:
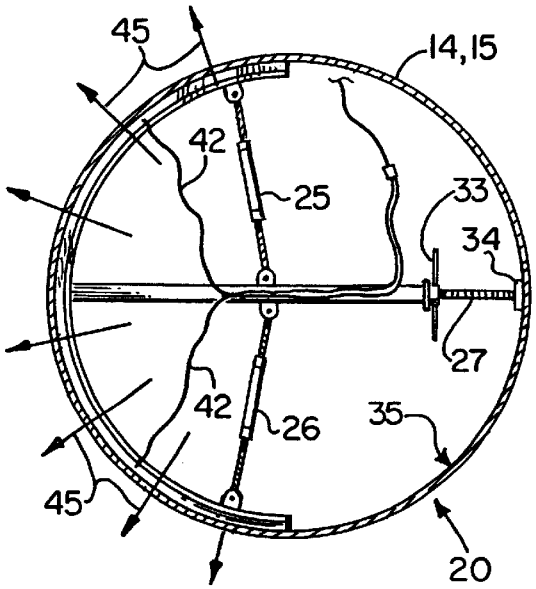
FIG. 11 is a top, plain view of the preferred embodiment of the apparatus of the present invention and illustrating the first step of the method of the present invention.
Figure 12:
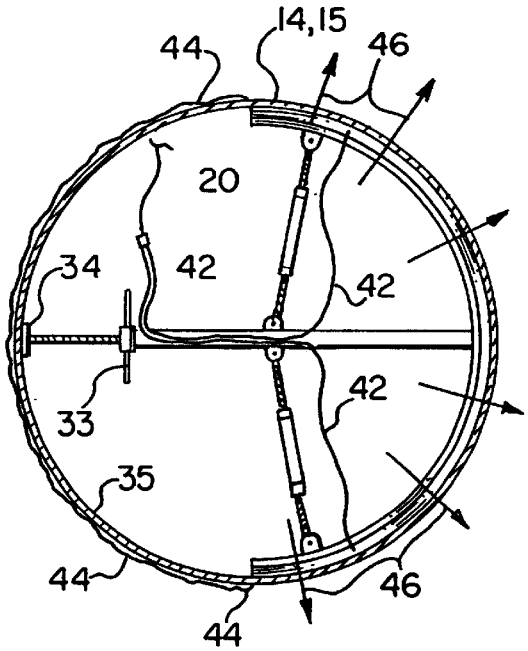
FIG. 12 is a top, plain view of the preferred embodiment of the apparatus of the present invention and illustrating the second of the method of the present invention.

Once the explosive apparatus 20 has been positioned as shown in FIGS. 11 and 12 against the inside surface 35 of a selected vertical member 14 or 15, an explosive charge 40 can be detonated to partially sever the leg 14 or 15. Explosive charge 40 is pressed against inside wall surface 35 of a jacket leg or vertical member 14, 15 as shown in FIG. 8. The explosive charge 40 is preferably about 5 pounds of explosives or less. The explosive 40 can be a plastic bonded explosive (PBX) in sheet form such as a manufactured Ensign Bickford Company or Hi Tech so that it can be layered. The curved member 24 engages and presses against the explosive charge 40 holding it against the inside surface 35 of the selected vertical member 14 or 15 (see FIGS. 4 and 8).

Figure 10:
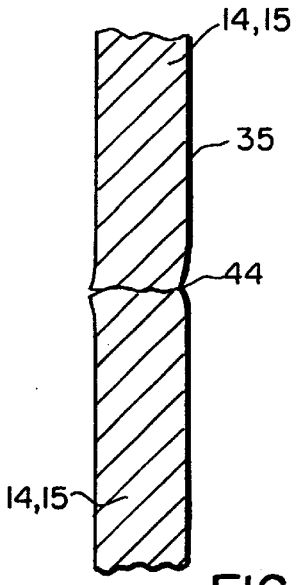
FIG. 10 is a fragmentary sectional elevational view illustrating the leg of a fixed platform after it has been severed using the method and apparatus of the present invention.
Figure 9:
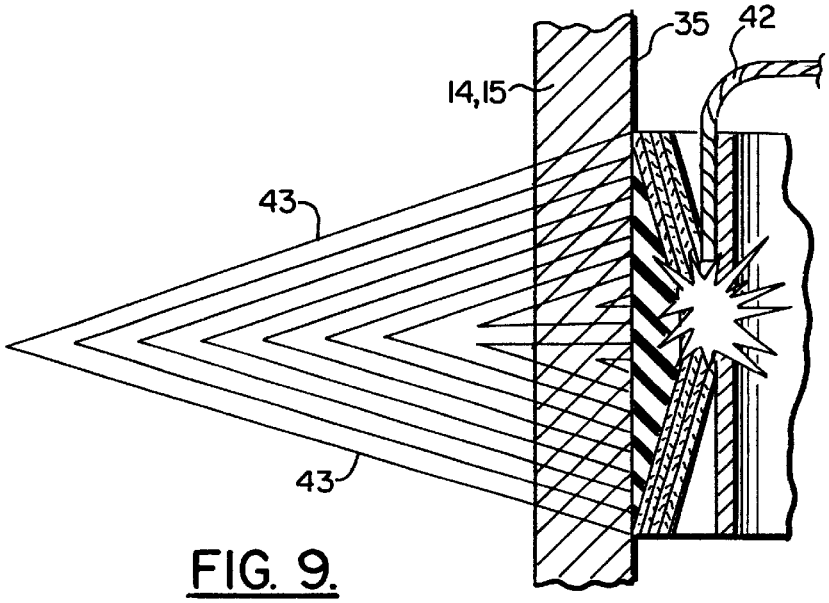
FIG. 9 is a fragmentary sectional elevational view of the preferred embodiment of the present invention showing destination of the explosive portion.

A rubber block 36 that is preferably trapezoidally shaped in cross section is positioned in between the explosive material 40 and the inside surface 35 of the selected vertical member 14 of 15. The block 36 thus provides a flat surface 37, and a pair of inclined surfaces 38, 39 that form an angle with the surface 37. The angle formed by surfaces 38 and 39 is preferably between about 100 and 160 degrees. Additionally, a flat surface 41 is provided in between the inclined surfaces 38, 39. The surface 41 is preferably parallel to the surface 37. Fuse 42 can be used to detonate the explosive charge 40. Multiple fuses 42 can be employed as shown in FIG. 11. In FIG. 9, lines of force 43 are shown demonstrating the focusing of explosive force to a focal point at the leg wall, using the apparatus 20 of the present invention to sever the vertical members 14 or 15. In FIG. 10, the numeral 44 indicates this focal point, namely the fracture site.

In FIGS. 11 and 12, the sequence of the method of the present invention is shown more particularly. In FIG. 11, the apparatus 20 is first positioned to cut one-half of the leg when explosive forces follow the pattern of arrows 45. In FIG. 12, a fracture 44 has been made extending about 180 degrees around a selected vertical member 14 or 15. In FIG. 12, the apparatus 20 has been repositioned as shown to fracture the remaining 180 degrees of the selected leg 14 or 15. The arrows 46 indicate the direction of force applied by the explosive charge in FIG. 12 as the second one-half portion (i.e. 180 degrees) of the selected leg or vertical member 14, 15 is cut. The platform vertical members such as 14, 15 can be cut one at a time. Alternatively, multiple vertical members or legs 14, 15 can be rigged with the apparatus 20 of the present invention so that charges can be detonated on multiple legs at one time which becomes an efficient procedure when dealing for example with very large offshore platforms 10.

Figure 13:
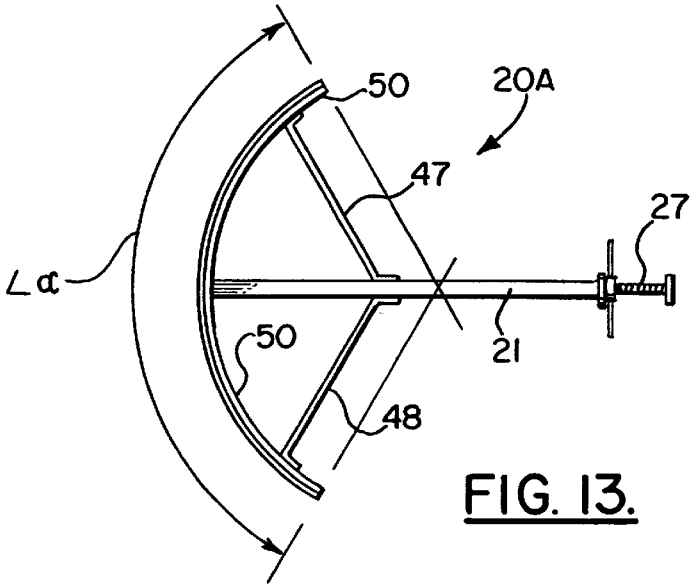
FIG. 13 is a top, plain view of an alternate embodiment of the apparatus of the present invention.

FIG. 13 shows an alternate version of the apparatus of the present invention, designated generally by the number 20A.

In the embodiment of FIG. 13, the telescoping member 21 is constructed like the embodiment of FIGS. 1–12. However, the curved member 24 is replaced by the curved member 24A that extends about 120 degrees as shown by the angle alpha in FIG. 13. With the embodiment of FIG. 13, the turnbuckles 25, 26 are replaced with rigid struts 47, 48. The curved member 50 holds and explosive charge 49 as configured like the embodiment of FIGS. 1–12, however it is shorter in length, extending a measure of about 120 degrees. With the embodiment of FIGS. 13, three positioning of frame 20A are required rather than the two positionings required for apparatus 20 as show in FIGS. 11 and 12.

Figure 14:
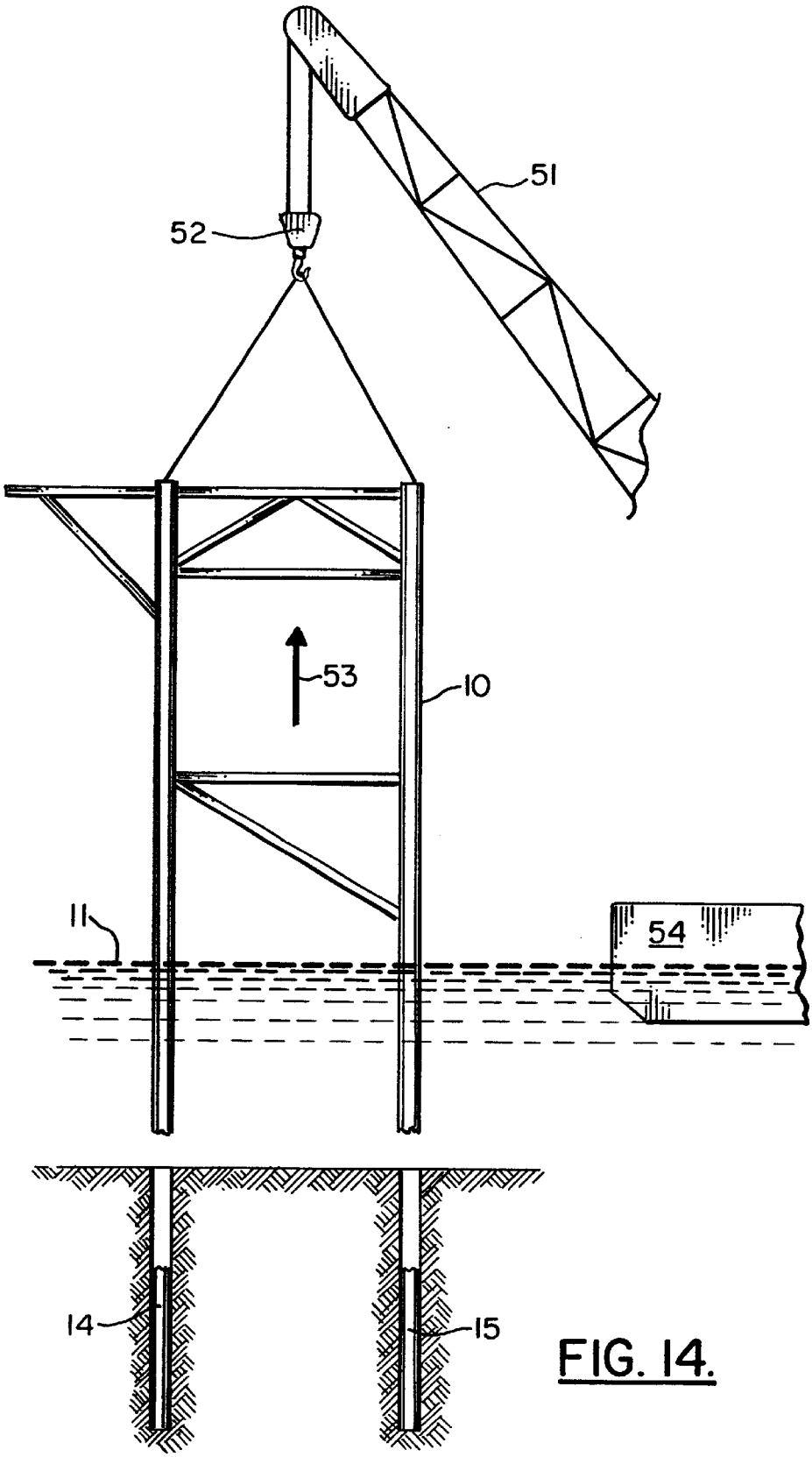
FIG. 14 is an elevational view illustrating the final method step of the present invention.

In FIG. 14, a crane 51 is shown having a crown block 52 for lifting platform 10 once it has been severed below the seabed 11. Once severed, the platform 10 can be lifted, leaving remnants of the legs 14, 15 well below the mud line in an environmentally less harmful position. The platform 10 can be lifted upwardly as shown by arrow 53 in FIG. 14. The salvaged platform 10 is placed upon barge 54 for transport to a remote location such as a salvage yard, fabrication yard, scrap yard or the like. Some platforms are reusable. The present invention is minimally invasive of the platform structure so that reuse is not compromised by the method of the present invention.

Figure 15:
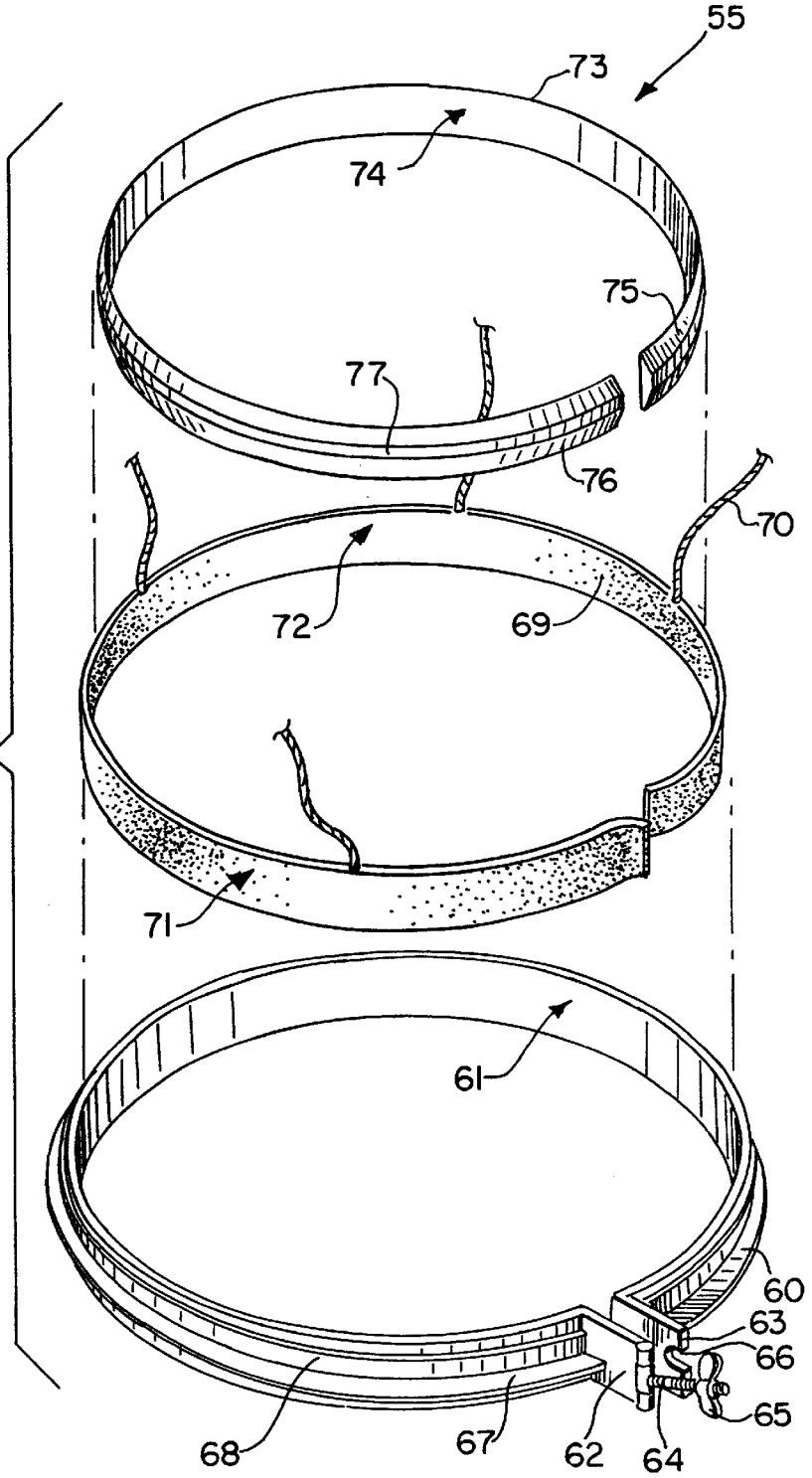
FIG. 15 is an exploded perspective view of a third embodiment of the apparatus of the present invention.
Figure 16:
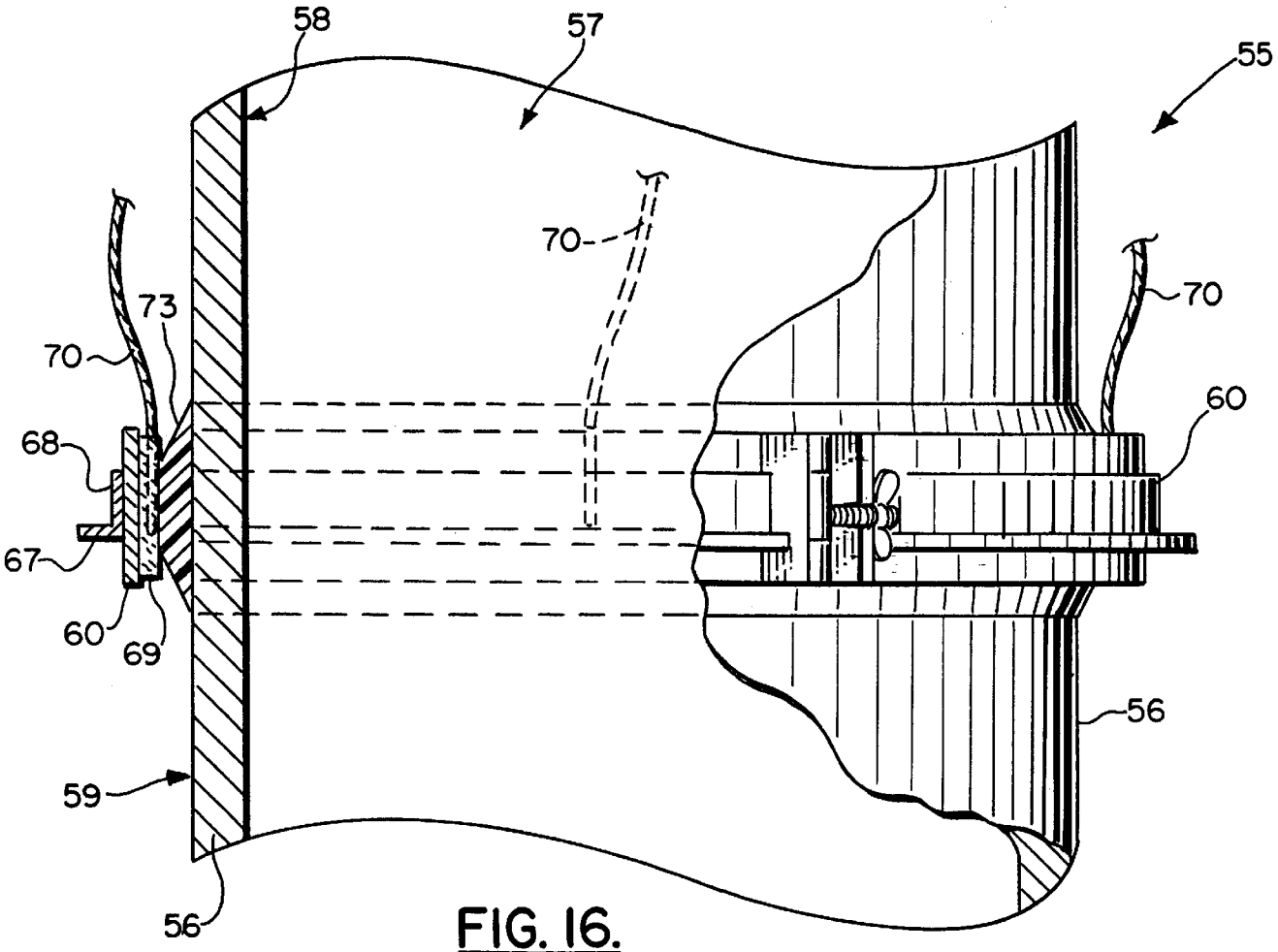
FIG. 16 is a sectional, elevational, partially cut away view of the third embodiment of the apparatus of the present invention.

FIGS. 15 and 16 show a third embodiment of the apparatus of the present invention designated generally by the numeral 55 in FIGS. 15 and 16.

Explosive apparatus 55 can be used on a leg member 56 by placing the apparatus 55 on the outer surface 39 of the leg member 56 as shown in FIG. 16. The leg member 56 has a hollow interior 57 surrounded by inner surface 58 of leg member 56.

In FIGS. 15 and 16, a generally circular strap member 60 has an inner surface 61 that is cylindrically shaped to conform generally to the cylindrically shaped outer surface 71 of explosive charge 69. The strap member 60 has a pair of flanges 62, 63 the form a closure when the strap member 60 is placed around leg 56 as shown in FIG. 16 and encircling wave shaper 73 and explosive charge 69.

The flanges 62, 63 are secured together during use, tightening the strap member 61 in position using threaded fastener 64 and wing nut 65. Slot 66 on flange 63 receives threaded fastener 64. The assembly is tightened with wing nut 65 once in position on leg 56.

The explosive charge 69 provides an inner surface 72 that is placed against wave shaper 73 and an outer surface 71 that is placed against surface 61 of strap member 60.

A beam that is comprised of pair of flanges 67, 68 can be placed at 90 degrees with respect to each other (e.g. welded) as shown in FIGS. 15 and 16 and welded to strap member 60 for reinforcing strap member 60.

Wave shaper 73 includes a cylindrically shaped inner surface 74 and a plurality of outer surfaces 75, 76, 77. The outer surface 77 is generally cylindrically shaped for engaging the flat inner surface 72 of explosive charge 69. A pair of beveled annular surfaces 75, 76 are inclined with respect to each other and with respect to inner surface 74 as shown in FIG. 16.

Figure 17:
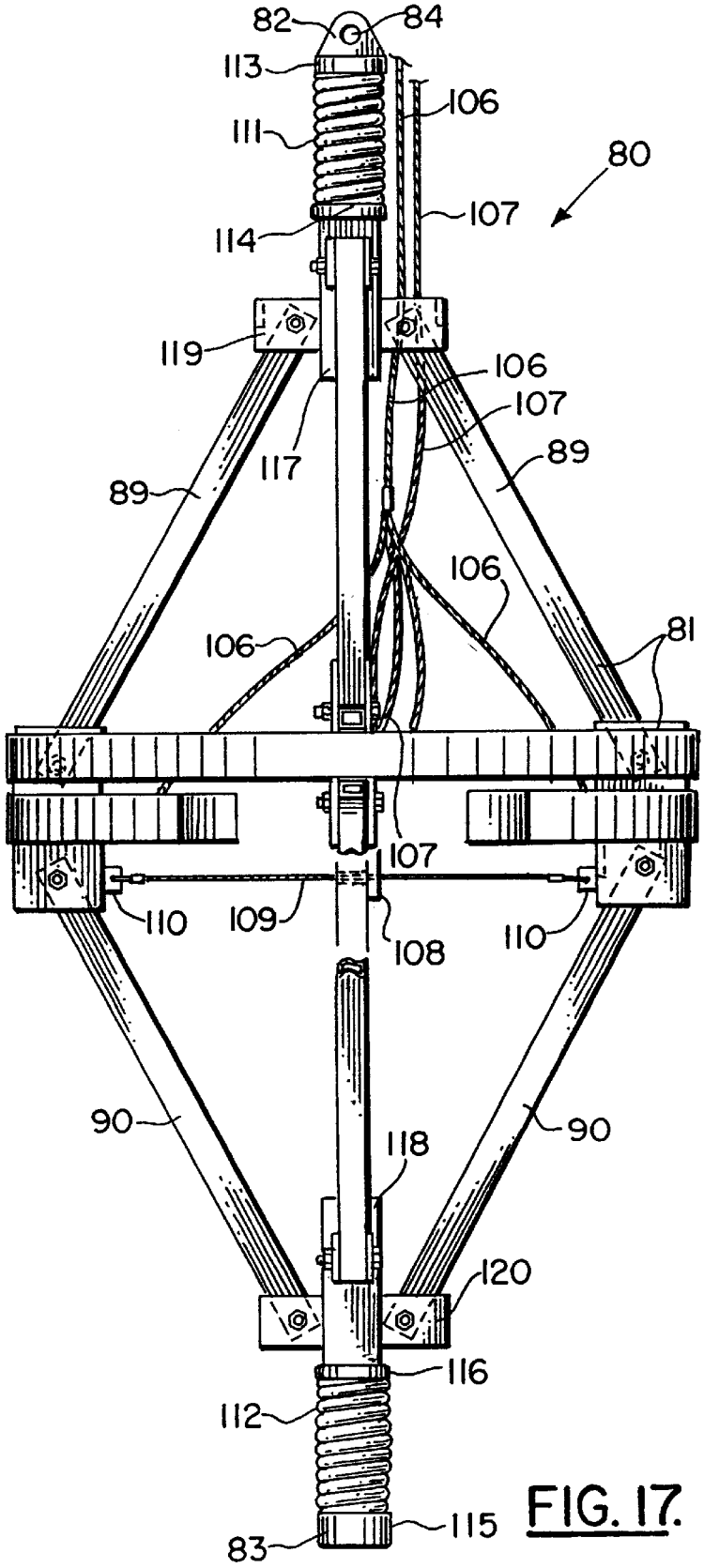
FIG. 17 is a side elevational view of a fourth embodiment of the apparatus of the present invention showing the delivery system of the present invention.

A fourth embodiment of the apparatus of the present invention, designated generally by the numeral 80 in FIG. 17, shows an improved delivery system and explosive apparatus for severing a leg or pipe in an underwater marine environment.

Figure 20:
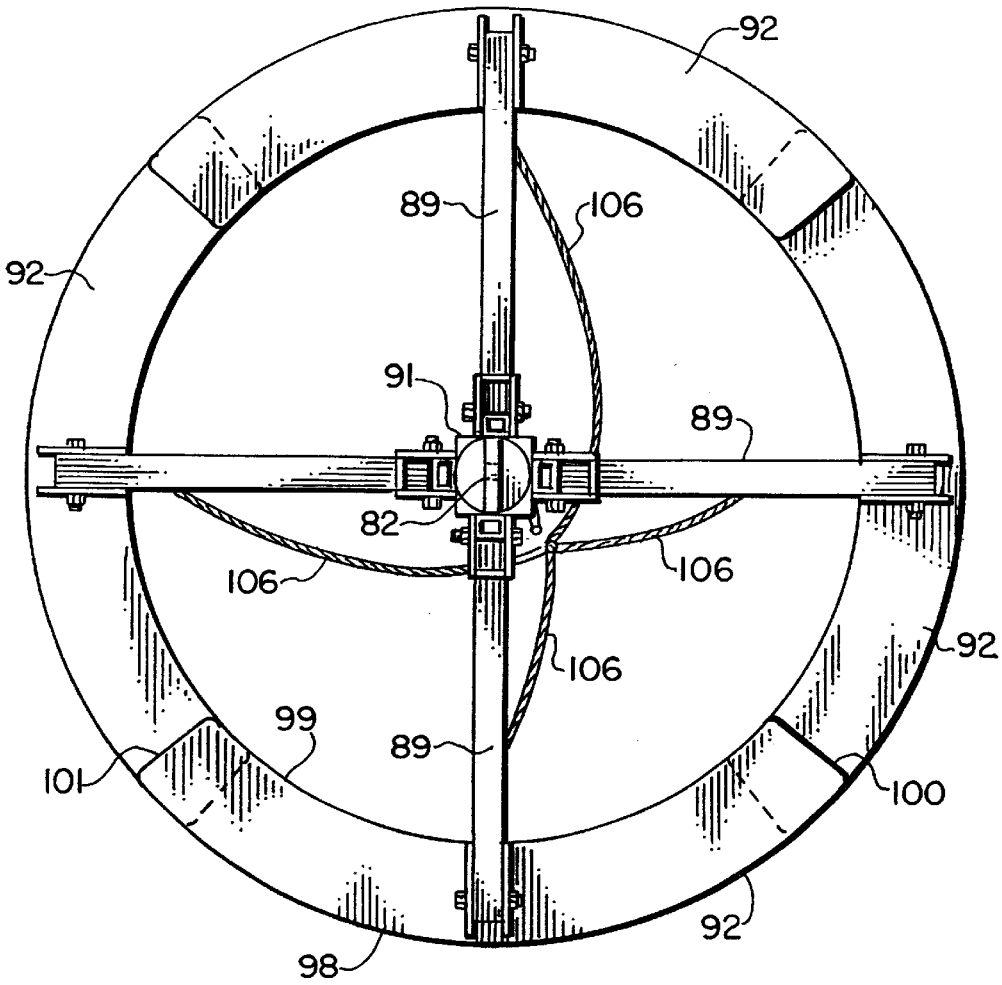
FIG. 20 is a top plan view of the delivery system in expanded position.
Figure 21:
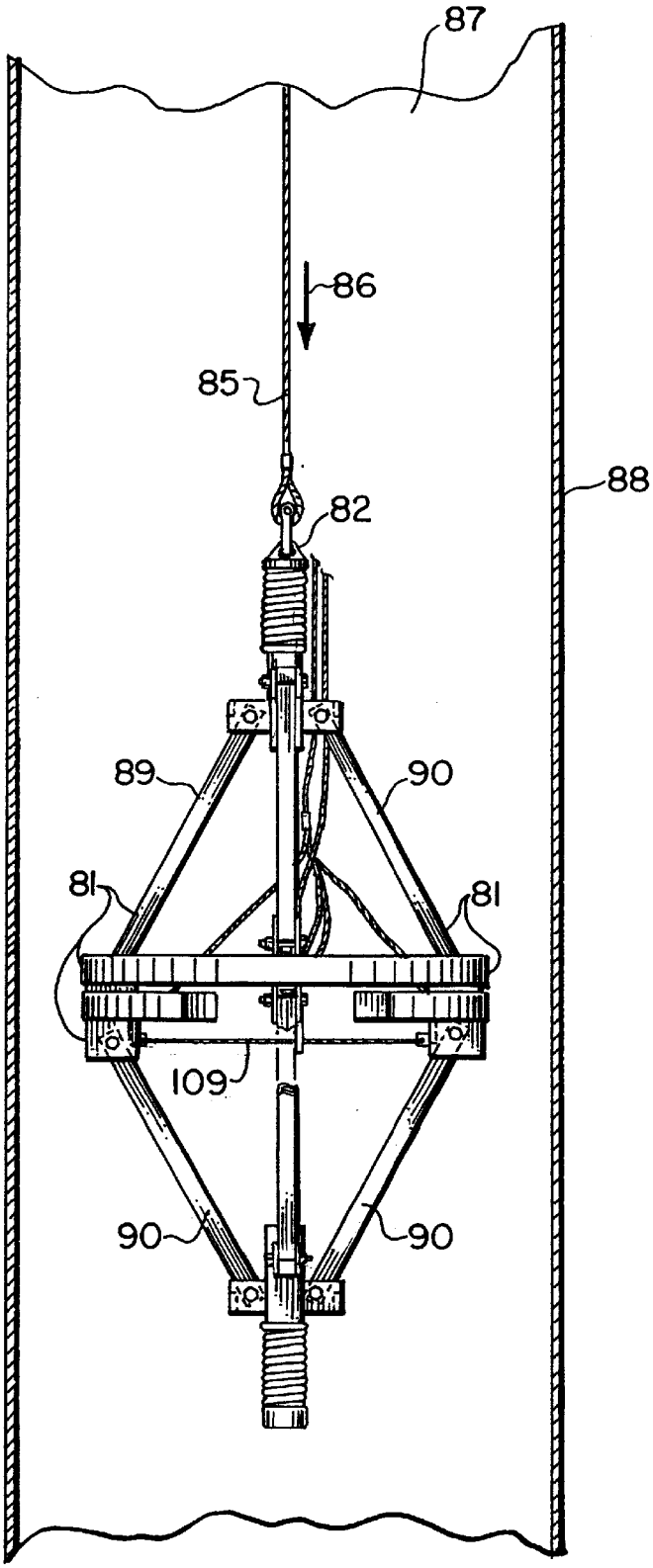
FIG. 21 is a side elevational view illustrating delivery of the frame and explosive charges as part of the delivery system and when the frame is in retracted position.

Delivery apparatus 80 includes a frame 81 having an upper end portion 82 and a lower end portion 83. An eyelet 84 can be used to secure a cable 85 to frame 81 so that the frame 81 can be lowered into a pipe, platform leg or like tubular member 88 as shown in FIG. 21 in the direction of arrow 86. Tubular member 88 has a bore 87 into which frame 81 is placed and lowered when the frame 81 is in the retracted position of FIGS. 17, 18, and 20.

The frame 81 is comprised of a central, vertical post 91 to which a plurality of struts are pivotally attached. An upper sleeve 117 slides upon post 91. Similarly, a lower sleeve 118 slides upon post 91. Attachment plates 119 extend laterally from sleeve 117. Upper struts 89 form pivotal attachments to sleeve 117 at attachment plates 119. Similarly, lower struts 90 are pivotally attached to lower sleeve 118 at plates 120.

A plurality of charge carriers 92 provide chambers 93 (see FIG. 23) for containing explosive material 94. A detonator 95 also communicates with chamber 93 for exploding the material 94. Shaper 96 is placed within chamber 93 for shaping the explosion, forming a cutting jet when material 93 is detonated. Chamber 93 is surrounded by housing 97 that includes arcuate wall 98, arcuate wall 99, flat end walls 100, 101, and upper and lower walls 102, 103.

Figure 22:
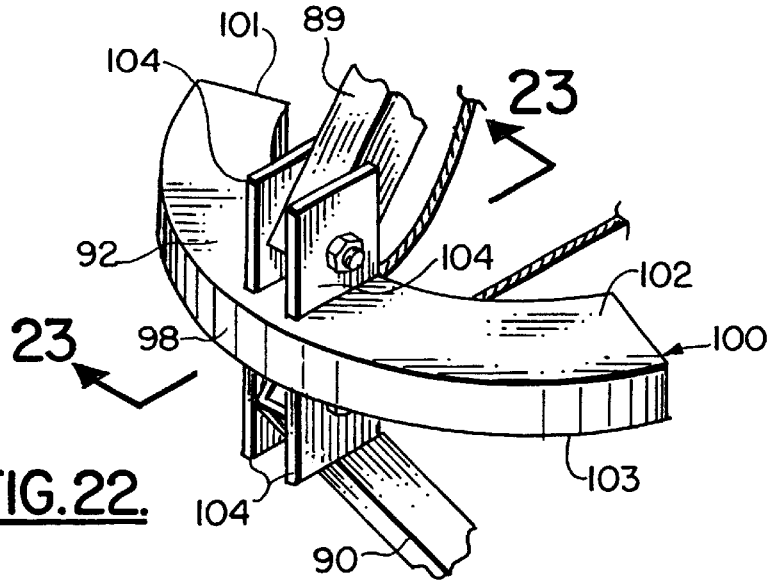
FIG. 22 is a fragmentary, perspective view of the delivery system of FIGS. 17–21.
Figure 23:
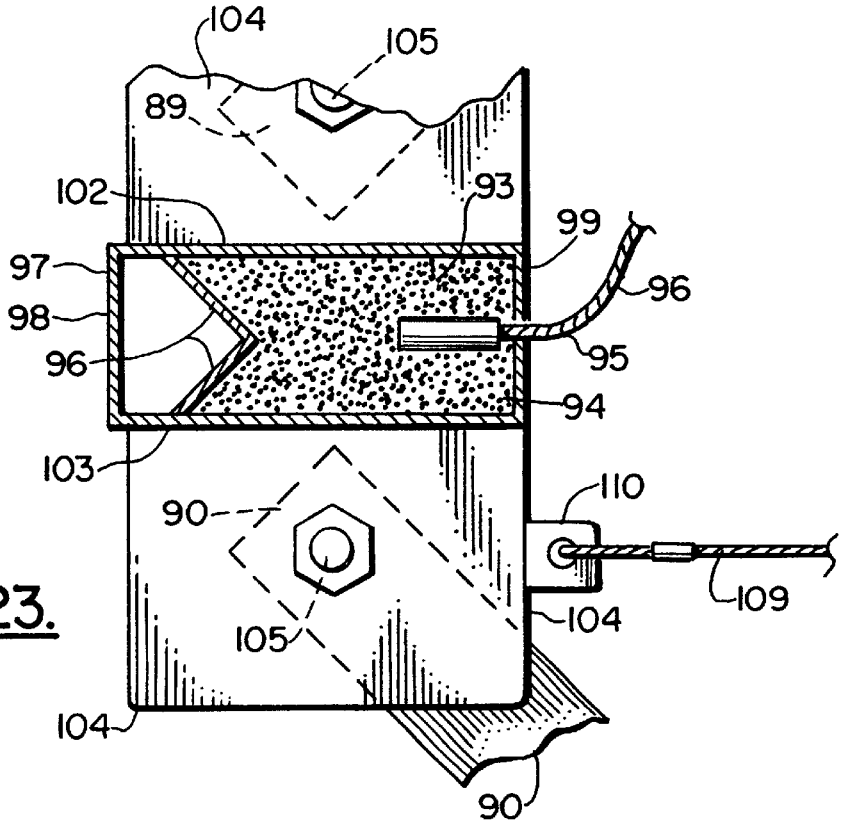
FIG. 23 is a side, fragmentary view taken along lines 23—23 of FIG. 22.

Attachment plates 104 extend upwardly from upper wall 102 and downwardly from bottom wall 103 as shown in FIG. 22. Bolted connections 105 can be used for attaching upper and lower struts 89, 90 respectively to housing 97 as shown in FIGS. 22 and 23.

Figure 18:
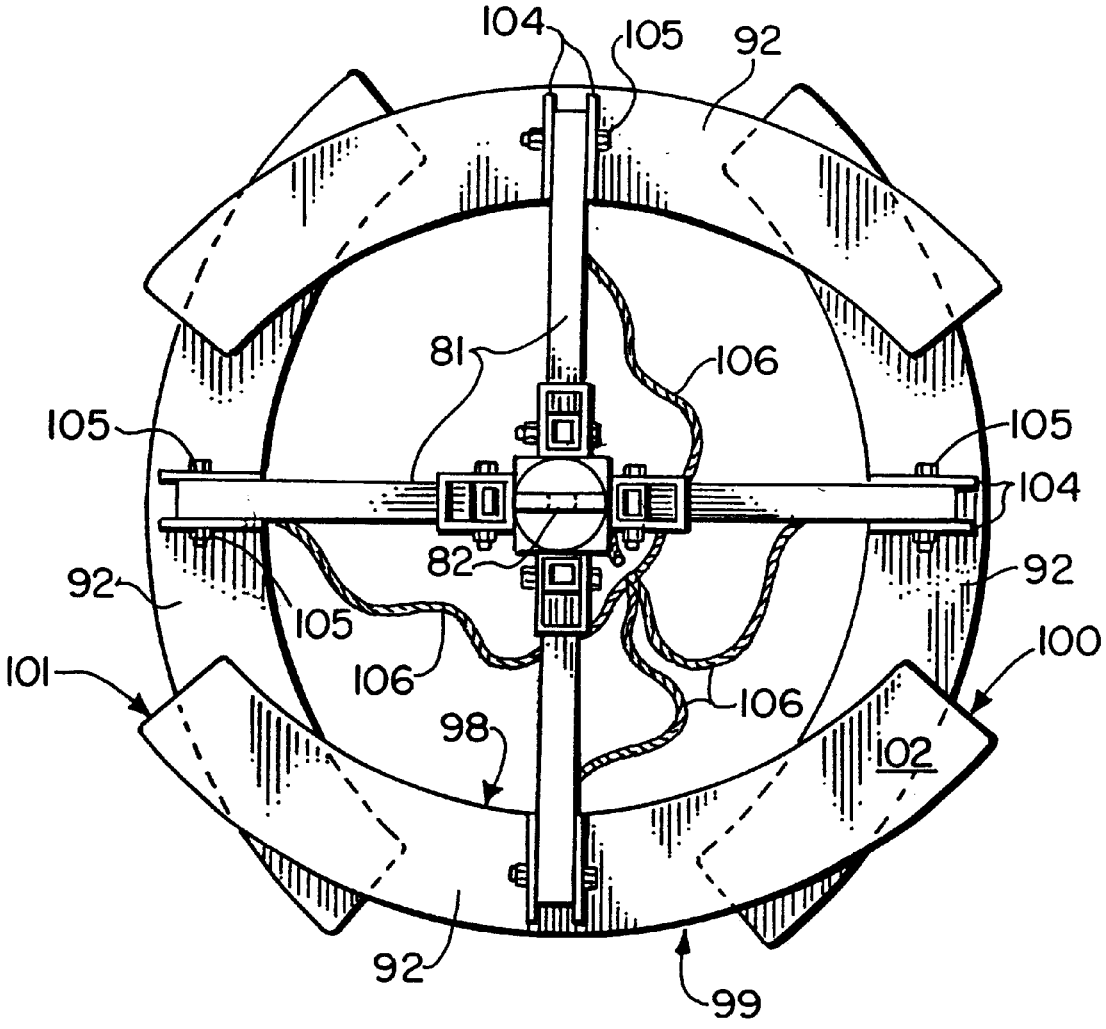
FIG. 18 is a top view of the delivery system in FIG. 17.

Detonating cord 106 is supplied to each of the detonators 95. Electric line 107 is used to detonate electric detonator 108. The electric detonator 108 is used to sever horizontal cable 109 that holds frame 81 in a retracted position as shown in FIGS. 17, 18 and 21. Horizontal cable 109 extends between gussets 110. The cable 109 holds the frame 81 in the retracted position of FIGS. 17 and 21 by compressing upper and lower springs 111, 112. Upper spring 111 extends between disc 113 and disc 114. Similarly, lower spring 112 extends between disc 115 and disc 116. The discs 114, 116 engage respective upper and lower sleeves 117, 118 as shown in FIG. 17.

Figure 24:
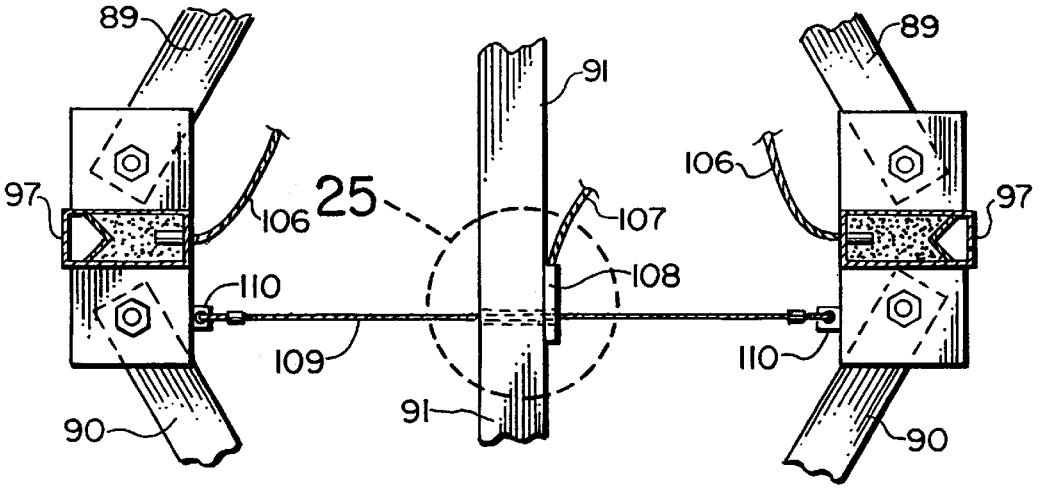
FIG. 24 is a side, fragmentary view of the frame portion of the delivery system of the present invention.
Figure 25:
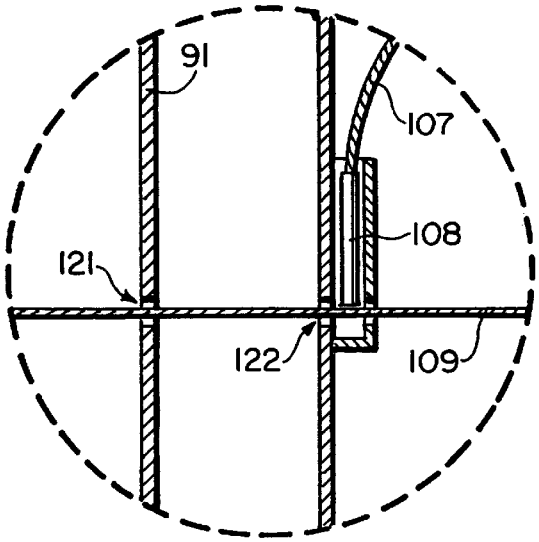
FIG. 25 is a fragmentary view illustrating the third embodiment of the apparatus of the present invention.
Figure 26:
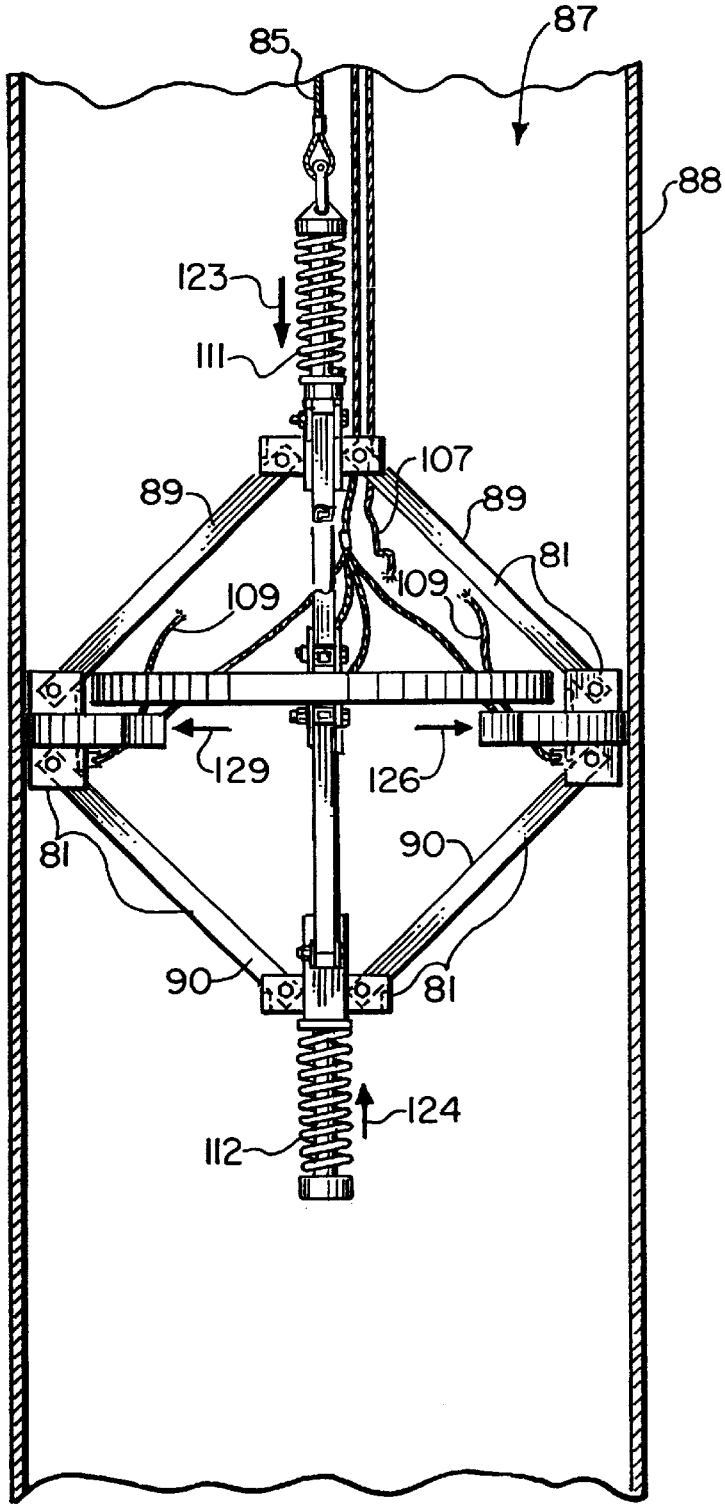
FIG. 26 is a side elevational view illustrating the expanded position of the delivery system.

When the apparatus 80 is to be deployed, it is lowered to a selected location inside the bore 87 of tubular member 88 as shown in FIG. 21. An operator then detonates the detonator 95 using primer cord 96. Electric line 107 is used for detonating electric detonator 108 to sever cable 109 as shown in FIGS. 24–26. The cable 109 extends through openings 121, 122 in post 91 as shown in FIG. 25.

Figure 19:
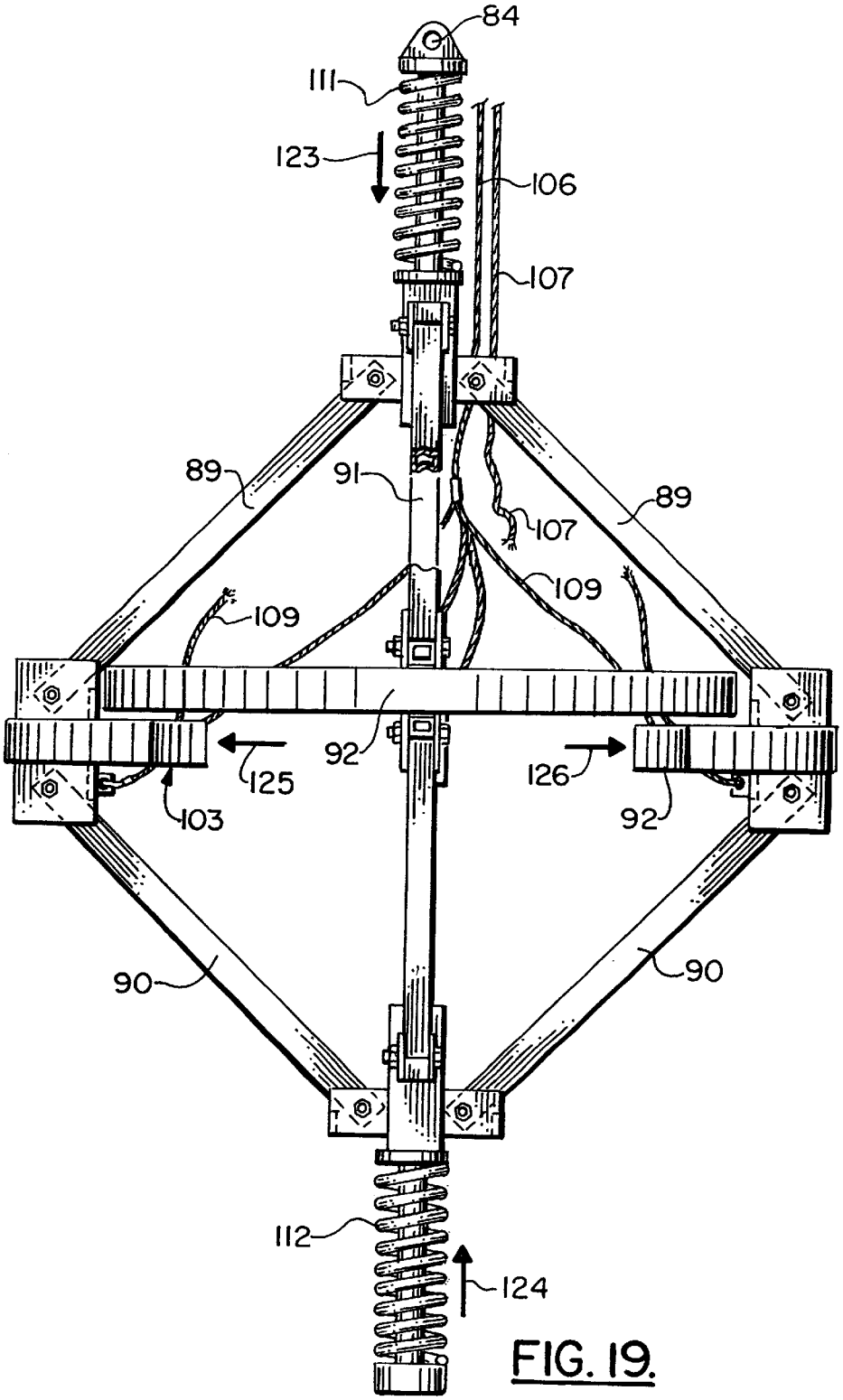
FIG. 19 is a side elevational view of the delivery system of FIGS. 17 and 18 shown in expanded position.
Figure 27:
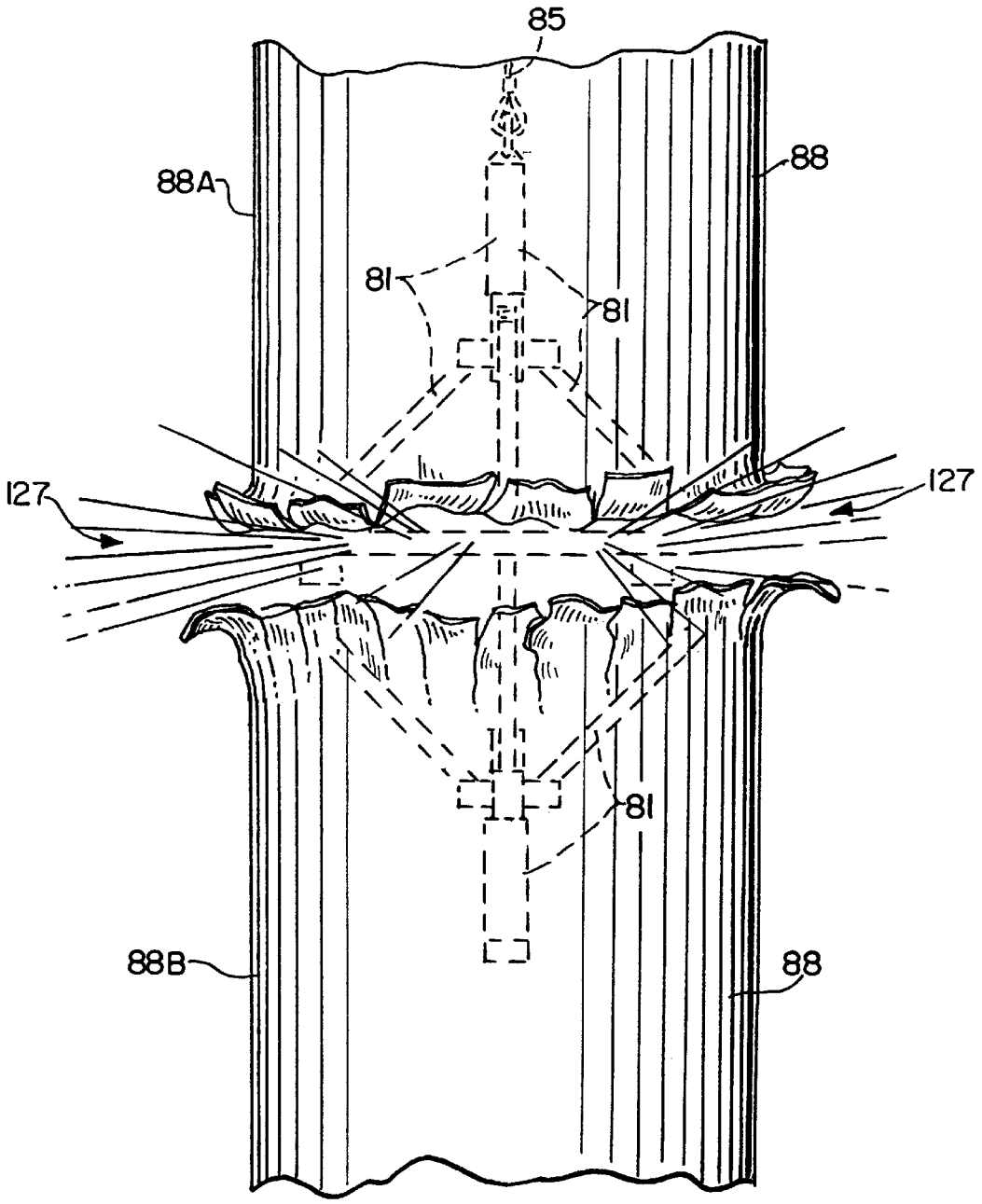
FIG. 27 is a schematic, side elevational view showing detonation of the charges that are part of the third embodiment of the apparatus of the present invention.

Once the detonator 108 severs cable 109, upper and lower springs 11, 112 expand as shown in FIG. 19. Springs 111, 112 urge the sleeves 117, 118 in the directions respectively of arrows 123, 124 causing the struts 89, 90 to push the charge carriers 92 outwardly in the direction of arrows 125, 126 (see FIG. 19). As shown in FIG. 26, the expanded frame 81 places charge carriers 92 against the inside surface of tubular member 88. Detonator cord 106 can then be used to detonate the explosive material 94 contained in chamber 93 severing the tubular member 88 into upper 88A and lower 88B sections and creating a fracture 127 (see FIG. 27).

The following table lists the parts numbers and parts descriptions as used herein and in the drawings attached hereto.

PARTS LIST

| Part Number | Description |
|---|---|
| 10 | fixed platform |
| 11 | mud line |
| 12 | seabed |
| 13 | water surface |
| 14 | vertical leg member |
| 15 | vertical leg member |
| 16 | transverse leg member |
| 17 | interior |
| 18 | diver |
| 19 | support cables |
| 20 | explosive apparatus |
| 20A | explosive apparatus |
| 21 | telescoping strut member |
| 22 | end |
| 23 | end |
| 24 | curved member |
| 24A | curved member |
| 25 | turnbuckle |
| 26 | turnbuckle |
| 27 | telescoping rod |
| 28 | threads |
| 29 | arrow |
| 30 | arrow |
| 31 | barrel |
| 32 | interval threads |
| 33 | handle |
| 34 | bar |
| 35 | inside wall surface |
| 36 | block |
| 37 | large flat surface |
| 38 | inclined surface |
| 39 | inclined surface |
| 40 | explosive change |
| 41 | small flat surface |
| 42 | fuse |
| 43 | force lines |
| 44 | fracture |
| 45 | arrow |
| 46 | arrow |
| 47 | strut |
| 48 | strut |
| 49 | explosive charge |
| 50 | curved member |
| 51 | crane |
| 52 | crown block |
| 53 | arrow |
| 54 | barge |
| 55 | explosive apparatus |
| 56 | leg member |
| 57 | hollow interior |
| 58 | inner surface |
| 59 | outer surface |
| 60 | strap member |
| 61 | inner surface |
| 62 | flange |
| 63 | flange |
| 64 | threaded fastener |
| 65 | wing nut |
| 66 | slot |
| 67 | flange |
| 68 | flange |
| 69 | explosive charge |
| 70 | fuse |
| 71 | outer surface |
| 72 | inner surface |
| 73 | wave shaper |
| 74 | cylindrical inner |
| 75 | annular surface |
| 76 | annular surface |
| 77 | annular surface |
| 80 | delivery apparatus |
| 81 | frame |
| 82 | upper end |
| 83 | lower end |
| 84 | eyelet |

-continued

PARTS LIST

| Part Number | Description |
|---|---|
| 85 | cable |
| 86 | arrow |
| 87 | bore |
| 88 | tubular member |
| 88A | upper section |
| 88B | lower section |
| 89 | upper strut |
| 90 | lower strut |
| 91 | central vertical post |
| 92 | charge carrier |
| 93 | chamber |
| 94 | explosive material |
| 95 | detonator |
| 96 | shaper |
| 97 | housing |
| 98 | arcuate wall |
| 99 | arcuate wall |
| 100 | flat end wall |
| 101 | flat end wall |
| 102 | upper wall |
| 103 | bottom wall |
| 104 | attachment plate |
| 105 | bolted connection |
| 106 | detonator cord |
| 107 | electric line |
| 108 | electric detonator |
| 109 | horizontal cable |
| 110 | gusset |
| 111 | upper spring |
| 112 | lower spring |
| 113 | disk |
| 114 | disk |
| 115 | disk |
| 116 | disk |
| 117 | sleeve |
| 119 | plate |
| 120 | plate |
| 121 | opening |
| 122 | opening |
| 123 | arrow |
| 124 | arrow |
| 125 | arrow |
| 126 | arrow |
| 127 | fracture |

The foregoing embodiments are presented by way of example only; the scope of the present invention is to be limited only by the following claims.

What is claimed is:

1. A method of removing an offshore fixed platform from the marine environment, said platform having a plurality of legs that extend below the seabed, each leg being hollow and having a leg wall with an inside surface, said method comprising the steps of:

a) placing an adjustable frame within the leg at the seabed area, the frame having multiple curved charge carriers, and being movable between retracted and expanded positions;

b) positioning an explosive charge and the frame next to the inside wall surface of the leg;

c) expanding the frame to the expanded position so that the frame engages the leg; and d) severing the wall of the leg by detonating the explosive charges.

2. The method of claim 1 wherein further comprising the step of focusing the charge in step "c" by shaping the charge at the interface between the leg and the frame.

3. The method of claim 1 wherein further comprising the step of remotely activating the frame in step "c" to expand.

4. The method of claim 3 wherein an explosive charge is detonated to activate the frame to move from the retracted to the expanded position.

5. The method of claim 1 wherein the frame includes multiple curved charge carrier sections and further comprising the step of supporting the explosive charge with the curved section of the frame.

6. The method of claim 1 wherein the frame includes multiple curved sections that are adjustable into multiple positions, and further comprising the step of supporting the explosive charge with the curved sections of the frame.

7. The method of claim 1 wherein the frame includes multiple curved sections that each extends less than about 180 degrees.

8. The method of claim 1 wherein the frame includes a central post, and upper and lower struts supported by the post.

9. The method of claim 1 wherein the frame includes multiple strut members that can be extended or retracted to fit differing diameter legs.

10. A method of removing an offshore fixed platform from the marine environment, said platform having a plurality of legs that extend below the seabed, each leg having a bore and having a leg wall with an inside surface, comprising the steps of:

a) lowering an adjustable frame into the bore of the leg at the seabed area, the frame having a curved portion that tracks the curvature of the platform leg;

b) supporting one or more explosive charges with the frame and the inside wall surface of the leg;

c) expanding the frame; and d) severing the wall of the leg by detonating the explosive charge.

11. The method of claim 10 wherein further comprising the step of focusing the charge in step "c" by shaping the charge at the interface between the leg and the frame.

12. The method of claim 10 wherein further comprising holding the frame in a retracted position in step "a".

13. The method of claim 10 further comprising using a link to hold the frame in the retracted position.

14. The method of claim 10 wherein the frame includes multiple curved sections and further comprising the step of supporting explosive charges with the curved sections of the frame.

15. The method of claim 10 wherein the frame includes curved sections and further comprising the step of supporting explosive charges with the curved sections of the frame that have been adjusted in step "c" to fit the curvature of the leg.

16. The method of claim 10 wherein the frame includes multiple curved sections that each extend circumferentially less than 360 degrees.

17. The method of claim 10 wherein in step "c" expanding the frame is remotely activated.

18. The method of claim 17 wherein the frame is expanded by detonating charge.

19. An apparatus for severing the legs of abandoned offshore fixed platforms, wherein said platform legs are hollow, having inside surfaces, comprising;

a) a frame that is movable between retracted and expanded positions;

b) an explosive charge supported by the frame;

c) an adjustment mechanism for fitting the frame to the leg; and d) wherein the frame includes multiple curved portions that each extend less than 360 degrees;

e) a remote controller for activating the frame to expand.

20. The apparatus of claim 19 wherein the curved portions extend less tan 180 degrees about the inside surface of the leg being severed.

21. The apparatus of claim 19 wherein each curved portion extends between 90 to 180 degrees about the inside surface of the leg being severed.

22. The apparatus of claim 19 wherein each curved portion extends less than 180 degrees about the inside surface of the leg being severed.

23. The apparatus of claim 19 wherein each curved portion carries an explosive charge.

24. The apparatus of claim 19 wherein the frame is comprised of a central post, a plurality of struts extending from the post, a plurality of charge carriers supported by the struts, springs for expanding the struts and charge carriers to an expanded position, and means for moving the charge carriers from a retracted to an expanded position.

* * * * *